US008894057B2

(12) United States Patent
Kato et al.

(10) Patent No.: US 8,894,057 B2
(45) Date of Patent: Nov. 25, 2014

(54) SHEET PROCESSING APPARATUS, METHOD FOR DETECTING LATERAL POSITION DEVIATION AMOUNT OF SHEET, AND IMAGE FORMING SYSTEM

(71) Applicant: Canon Kabushiki Kaisha, Tokyo (JP)

(72) Inventors: Hitoshi Kato, Toride (JP); Naoki Ishikawa, Kashiwa (JP)

(73) Assignee: Canon Kabushiki Kaisha (JP)

( * ) Notice: Subject to any disclaimer, the term of this patent is extended or adjusted under 35 U.S.C. 154(b) by 35 days.

(21) Appl. No.: 13/870,143

(22) Filed: Apr. 25, 2013

(65) Prior Publication Data

US 2013/0287463 A1 Oct. 31, 2013

(30) Foreign Application Priority Data

Apr. 27, 2012 (JP) ..... 2012-102876

(51) Int. Cl.
*B26D 5/00* (2006.01)
*B26D 5/28* (2006.01)
*G03G 15/00* (2006.01)

(52) U.S. Cl.
CPC .. *G03G 15/6529* (2013.01); *G03G 2215/00721* (2013.01); *G03G 15/6573* (2013.01)
USPC ..... 270/58.02; 270/58.07

(58) Field of Classification Search
USPC ..... 270/58.02, 58.07, 58.17, 58.27; 271/184, 185, 225, 226, 227, 228; 83/76.8, 80, 211, 367, 368, 370
See application file for complete search history.

(56) References Cited

U.S. PATENT DOCUMENTS

| | | | | |
|---|---|---|---|---|
| 7,003,257 | B2 * | 2/2006 | Yoshie et al. | 399/389 |
| 7,520,497 | B2 * | 4/2009 | Moriyama et al. | 270/58.07 |
| 8,011,649 | B2 * | 9/2011 | Yahata et al. | 270/58.07 |
| 8,042,796 | B2 * | 10/2011 | Iguchi | 270/58.07 |
| 8,066,279 | B2 * | 11/2011 | Ishikawa et al. | 271/228 |
| 8,186,664 | B2 * | 5/2012 | Yahata et al. | 270/58.07 |
| 2013/0036886 | A1 * | 2/2013 | Kato et al. | 83/73 |

FOREIGN PATENT DOCUMENTS

JP 2005-342943 A 12/2005

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus capable of detecting a lateral position deviation amount of a sheet with high precision and at a high speed. A sheet sensing unit includes two or more sensors, each of which sensing a side edge of the sheet, disposed in a widthwise direction of the sheet. A position deviation amount of the sheet in the widthwise direction is detected based on a moving distance of the sheet sensing unit until at least one of the sensors senses the side edge of the sheet. The position deviation amount of the sheet is determined using a sensing result of the side edge of sheet after the sheet sensing unit moves by a predetermined distance, while invalidating a sensing result of the side edge of sheet sensing unit in the widthwise direction from when a driving unit starts driving until the sheet sensing unit moves by the predetermined distance.

15 Claims, 8 Drawing Sheets

SHEET PROCESSING APPARATUS, METHOD FOR DETECTING LATERAL POSITION DEVIATION AMOUNT OF SHEET, AND IMAGE FORMING SYSTEM

BACKGROUND OF THE INVENTION

1. Field of the Invention

The present invention relates to a sheet processing apparatus that detects a deviation of a sheet in a widthwise direction thereof intersecting a sheet transport direction and correct the deviation, a method for detecting a lateral position deviation amount of a sheet, and an image forming system.

2. Description of the Related Art

A conventional existing sheet processing apparatus includes an apparatus that includes a hole punching mechanism to make a hole in a sheet. Among this type of apparatus, there exists an apparatus in which, when a hole is to be made in a sheet, a deviation amount of a sheet in a widthwise direction thereof intersecting a sheet transport direction (hereinafter, referred to as "lateral position deviation amount") is corrected in order to improve accuracy in a hole position. Correction of the lateral registration deviation is typically carried out by sensing a lateral position deviation amount while transporting a sheet and by moving the sheet or the hole punching mechanism in the widthwise direction of the sheet intersecting the sheet transport direction, based on the sensing result.

Here, as a method for sensing a lateral position deviation amount of a sheet, there exists a method in which a sheet sensor for sensing the sheet is moved in the widthwise direction of the sheet intersecting the sheet transport direction and the lateral position deviation amount of the sheet is obtained from a moving amount of the sheet sensor from the start of the move until the sheet sensor senses an edge of the sheet in the widthwise direction (see Japanese Laid-Open Patent Publication (Kokai) No. 2005-342943, for example). In such a method, by using a stepping motor as a motor for moving the sheet sensor, the moving amount of the sheet sensor from when the sheet sensor starts moving until the sheet is sensed can be obtained indirectly from a driving pulse of the motor. Accordingly, an apparatus for directly detecting the moving amount of the sheet sensor becomes unnecessary, which makes it possible to detect the lateral position deviation amount of the sheet with an inexpensive configuration.

However, with the above-described conventional technique, it may take time until the sheet sensor comes to move proportionally to a driving amount of a sensor driving motor after the sensor driving motor has started. In particular, in a case where a drive force transmission unit comprises a belt, as the belt stretches, it is apt to take longer for the sheet sensor to come to move proportionally to the driving amount of the sensor driving motor.

Thus, a method of obtaining a moving amount of the sheet sensor from the start of its movement until the sheet is sensed based on the driving pulse of the sensor driving motor has a problem of disabling the moving amount of the sheet sensor to be accurately obtained immediately after the start of the sensor driving motor, thereby reducing sensing precision of the lateral position deviation amount of the sheet with respect to the normal sheet transport position.

Further, to counter such a problem, a stand-by position of the sheet sensor may be away from the sheet so that the sheet sensor does not sense the sheet until the moving amount of the sheet sensor becomes proportional to the driving pulse of the sensor driving motor. However, such a method leads to another problem of the moving amount of the sheet sensor being increased, thereby taking time to sense the lateral position deviation amount of the sheet.

SUMMARY OF THE INVENTION

The present invention provides a sheet processing apparatus that is capable of detecting a lateral position deviation amount of a sheet with high precision and at a high speed, a method for detecting a lateral position deviation amount of a sheet, and an image forming system.

In an aspect of the invention, there is provided a sheet processing apparatus comprising: a sheet transport unit configured to transport a sheet; a sheet sensing unit including two or more sensors, each of the sensors being configured to sense the sheet, disposed in a widthwise direction of the sheet intersecting a sheet transport direction by the sheet transport unit; a driving unit configured to move the sheet sensing unit in the widthwise direction; a drive force transmission unit configured to transmit a driving force of the driving unit to the sheet sensing unit; and a position deviation detecting unit configured to detect a position deviation amount of the sheet in the widthwise direction based on a moving distance of the sheet sensing unit through the driving unit until at least one of the two or more sensors senses the sheet, wherein the position deviation detecting unit invalidates a sensing result of the sheet by the sheet sensing unit from when the driving unit starts driving until the sheet sensing unit moves by a predetermined distance, and determines the position deviation amount of the sheet using a detection result of the sheet after the sheet sensing unit moves by the predetermined distance.

According to the present invention, the deviation amount of the sheet in the widthwise direction is detected using a detection result of the position deviation amount of the sheet in the widthwise direction after the sheet sensing unit has moved by the predetermined distance, while invalidating the detection result of the position deviation amount of the sheet in the widthwise direction from when the driving unit states driving until the sheet sensing unit moves by the predetermined distance. This cancels a following delay in a moving distance of a sensing section with respect to the driving amount of the moving unit, which makes it possible to detect the lateral position deviation amount of the sheet with high precision and at a high speed.

Further features of the present invention will become apparent from the following description of exemplary embodiments with reference to the attached drawings.

DESCRIPTION OF THE EMBODIMENTS

The present invention will now be described in detail with reference to the attached drawings.

Figure 1:
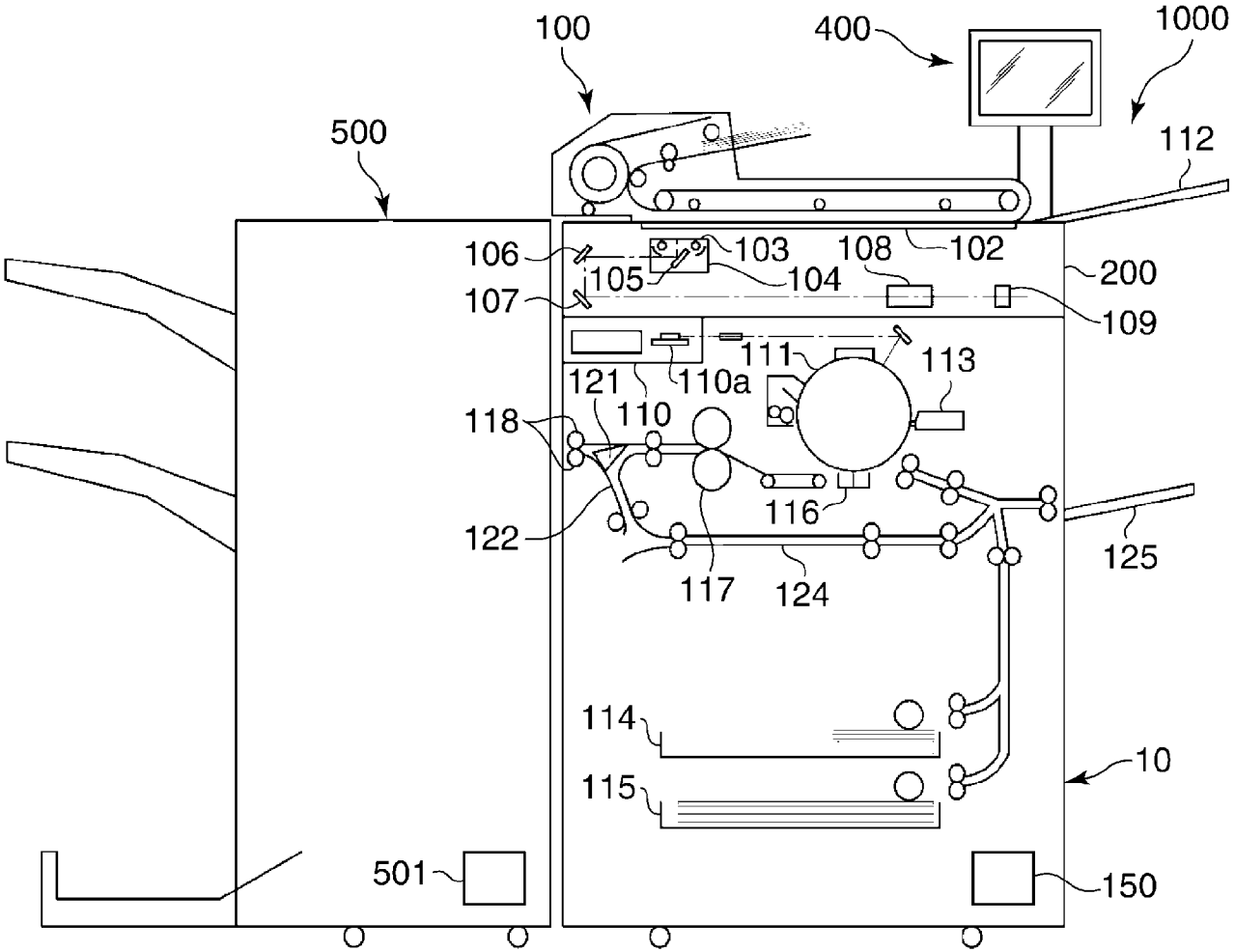
FIG. 1 is a sectional view schematically showing a configuration of an image forming system according to an embodiment of the present invention.

FIG. 1 is a sectional view schematically showing a configuration of an image forming system according to an embodiment of the present invention.

In FIG. 1, an image forming system 1000 includes an image forming apparatus 10, an image reader 200 disposed in an upper part of the image forming apparatus 10, and a document feeding apparatus 100 and an operation display apparatus 400 disposed on the image reader 200. The image forming system 1000 further includes a sheet processing apparatus 500 connected to the image forming apparatus 10 at a sheet discharge side thereof.

The document feeding apparatus 100 sequentially feeds documents that are set facing upward, e.g., in a document tray one by one from the first page toward the left in FIG. 1, and subsequently transports the document from the left to the right through a reading position on a platen glass 102 via a curved path, the document discharged to an external discharge tray 112.

When the document passes through the reading position on the platen glass 102, an image on the document is read by a scanner unit 104 of the image reader 200 arranged at a position corresponding to the reading position. That is, the scanner unit 104 reads the image on the document being transported through the reading position with a direction orthogonal to a document transport direction as a main scanning direction and with the document transport direction as a sub-scanning direction. Specifically, when the document is transported through the reading position, a read surface of the document is irradiated with a light from a lamp 103 of the scanner unit 104, and a reflection light from the document is guided to a lens 108 through mirrors 105, 106, and 107. The reflection light having passed through the lens 108 forms an image on an imaging surface of a downstream image sensor 109. The image sensor 109 reads the image of the document line by line in the main scanning direction and further reads the entire image of the document as the document is transported in the sub-scanning direction.

The image sensor 109 converts an optically read image of the document into image data and subsequently outputs the image data. The image data outputted from the image sensor 109 is subjected to predetermined processing in an image signal control section 202, which will be described later, before the image data is inputted to an exposure control section 110 of the image forming apparatus 10 as a video signal.

The exposure control section 110 modulates a laser light based on the inputted video signal and outputs the modulated laser light. The outputted laser light is irradiated onto a photoconductive drum 111 while being scanned by a polygon mirror 110*a*, with an electrostatic latent image to be formed on a surface of the photoconductive drum 111 in accordance with the scanned laser light.

The electrostatic latent image on the surface of the photoconductive drum 111 is visualized by developer such as toner supplied from a developing unit 113. In synchronization with a timing of the start of laser light irradiation, a sheet of paper (hereinafter simply referred to as "the sheet") is fed from a cassette 114 or 115, a manual paper feeding section 125, or a double-side transport path 124, with this sheet transported into between the photoconductive drum 111 and a transfer section 116. Then, a toner image that is formed on the surface of the photoconductive drum 111 is transferred onto a face of the sheet by the transfer section 116.

The sheet onto which the toner image has been transferred is transported to a fixing section 117, where, as the sheet is heated with pressure, the transferred toner image is fixed onto the sheet face. The sheet having passed through the fixing section 117 is discharged to the outside of the image forming apparatus 10 through a flapper 121 and discharge rollers 118.

When the sheet is discharged with an image forming face thereof facing downward, the sheet having passed through the fixing section 117 is once guided into a reverse path 122 through a switching operation of the flapper 121. Then, after a trailing edge of the sheet having passed through the flapper 121, the sheet is switched back and discharged from the image forming apparatus 10 by the discharge rollers 118. Hereinafter, such a paper discharge mode is called "the reverse discharge". The reverse discharge is employed when an image is sequentially formed from the first page, for example, when an image read by using the document feeding apparatus 100 is to be formed or when an image outputted from a computer is to be formed, with the order of the discharged sheets sequentially corrected.

Meanwhile, when a double-sided recording where images are to be formed on both sides of the sheet is set, the control is carried out as below. That is, the sheet having a toner image fixed onto one face thereof after having passed through the fixing section 117 is guided to the reverse path 122 by switching the flapper 121 and then is transported to a double-side transport path 124. Thereafter, the reversed sheet is again fed into between the photoconductive drum 111 and the transfer section 116 at the aforementioned timing to form an image on the other face of the sheet.

The sheet processing apparatus 500 in FIG. 1 will now be described in detail.

Figure 2:
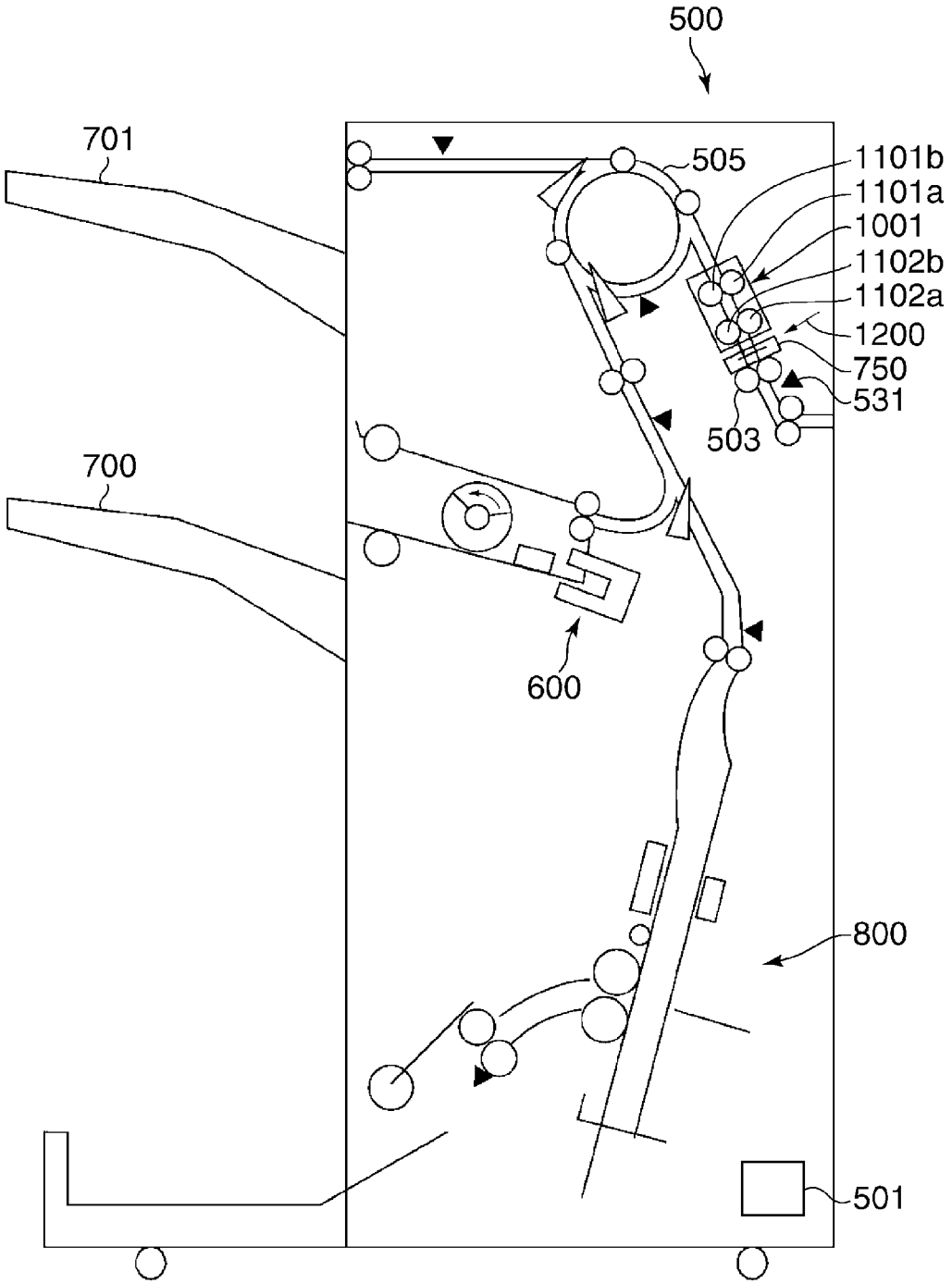
FIG. 2 is a sectional view schematically showing a schematic configuration of a sheet processing apparatus in FIG. 1.

FIG. 2 is a sectional view schematically showing a configuration of the sheet processing apparatus in FIG. 1.

In FIG. 2, the sheet processing apparatus 500 includes a punch section 750 that makes a punch hole in the sheet along a transport direction of the sheet, a staple section 600 that staples the sheets, and a binding section 800 that folds a bundle of the sheets in half for binding. The sheet processing apparatus 500 further includes a tray 700 that mounts the sheets properly processed and a proof tray 701 that mounts the sheets improperly processed.

The punch section 750 is disposed in a sheet take-in section of the sheet processing apparatus 500. A sensor 531 that senses the sheet transported into the sheet processing apparatus 500 and a transport roller pair 503 that transports the sheet are disposed in an upstream side of the punch section 750 in the sheet transport direction. Further, a shift unit 1001 is disposed in a downstream side of the punch section 750 in the sheet transport direction to transport the sheet while shifting the sheet to a predetermined widthwise position in a shift sort mode where the sheet is discharged being offset or in a punch mode where a punch hole is made in a sheet. The shift unit 1001 includes transport rollers 1101*a* and 1102*a*, and driven rollers 1101*b* and 1102*b*. Further, a buffer roller 505 is disposed in a downstream side of the shift unit 1001 in the sheet transport direction.

The sheet processing apparatus 500 carries out processing of taking in a plurality of the sheets discharged from the image forming apparatus 10 to bundle the taken-in sheets with alignment, sort processing, non-sort processing, and so on. Specifically, the punch section 750 carries out punch processing to make punch holes at a trailing edge side of the sheet bundle, the staple section 600 carries out staple processing to staple the trailing edge side of the sheet bundle, and the binding section 800 carries out saddle stitch binding processing.

The shift unit 1001 disposed in a downstream side of the punch section 750 in the sheet transport direction will now be described.

Figure 3:
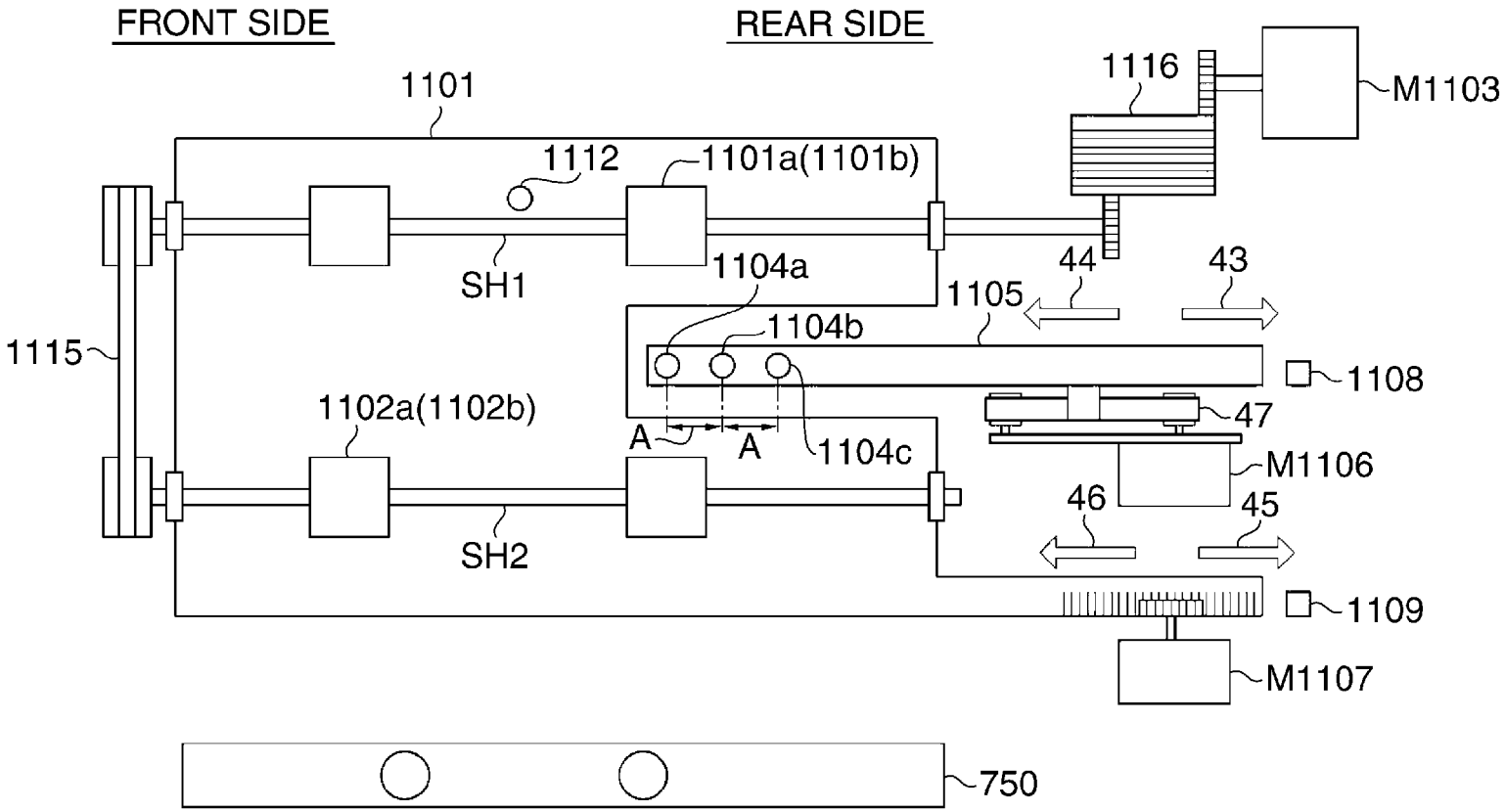
FIG. 3 is a diagram schematically showing a configuration of a lateral position shift unit in FIG. 2.

FIG. 3 is a diagram schematically showing a configuration of the shift unit 1001 of FIG. 2.

FIG. 3 illustrates two shafts SH1 and SH2 that are respectively driven by a timing belt 1115, and a roller 1101*a* (a driven roller 1101*b*) and a transport roller 1102*a* (a driven roller 1102*b*) disposed on the shafts SH1 and SH2, respectively. A transport motor M1103 is connected to the shaft SH1 through a gear 1116. A side edge sensor unit 1105 including a plurality of side edge sensors 1104*a* to 1104*c* is disposed between the shafts SH1 and SH2. A sensor moving motor M1106 is connected to the side edge sensor unit 1105 through a timing belt 47. It should be noted that the timing belt 47 may stretch immediately after the sensor moving motor M1106 has started or in accordance with a change of an environmental temperature or the like, and in some cases, it may take time for the side edge sensor unit 1105 to move linearly following the drive force of the sensor moving motor M1106. Hereinafter, the fact that the side edge sensor unit 1105 "moves linearly following the drive force" of the sensor moving motor M1106 will be expressed as that the side edge sensor unit 1105 "moves proportionately to the drive force" of the sensor moving motor M1106.

Further, FIG. 3 illustrates a shift motor M1107 that drives the shift unit 1101 formed separately from the side edge sensor unit 1105 in a lateral direction of the sheet intersecting the sheet transport direction as indicated by arrows 45 and 46. A home position of the shift unit 1101 is detected by a shift unit HP sensor 1109. Further, a sheet trailing edge sensor 1112 is disposed in the vicinity of the shaft SH1, and a trailing edge of the transported sheet is sensed by the sheet trailing edge sensor 1112. The sheet trailing edge sensor 1112 senses that the trailing edge of the sheet has passed through the transport roller 1101*a* and the driven roller 1101*b* of the shift unit 1001.

In the shift unit 1101 as above, the transport motor M1103 is started, and the transport rollers 1101*a* and 1102*a* are driven through the gear 1116, the shaft SH1, the timing belt 1115, and the shaft SH2. The transport rollers 1101*a* and 1102*a* cooperate with the driven rollers 1101*b* and 1102*b* to transport a sheet.

A side edge of the sheet is detected by the side edge sensors 1104*a*, 1104*b*, and 1104*c*. The side edge sensors 1104*a*, 1104*b*, and 1104*c*, that is, the sensing sections are spaced from one another by A mm. The A mm, for example, is 10 mm. Each of the side edge sensors 1104*a* to 1104*c* is configured of a light emitting element and a light receiving element and is configured similarly to one another. The side edge sensor unit 1105 including the side edge sensors 1104*a* to 1104*c* is driven by the sensor moving motor M1106 through the timing belt 47 and moves along an arrow 44 or 43.

Here, immediately after the sensor moving motor M1106 is started, the timing belt 47 slightly stretches, and thus, typically, the side edge sensor unit 1105 does not follow a rotation amount of the sensor moving motor M1106. Once the sensor moving motor M1106 rotates to a certain degree, a delay in transmission due to the timing belt 47 stretching is resolved, and a moving distance of the side edge sensor unit 1105 becomes proportional to the rotation amount of the sensor moving motor M1106. A stand-by position of the side edge sensor unit 1105 is detected by a HP sensor 1108.

A control system of the image forming system 1000 of FIG. 1 will now be described.

Figure 4:
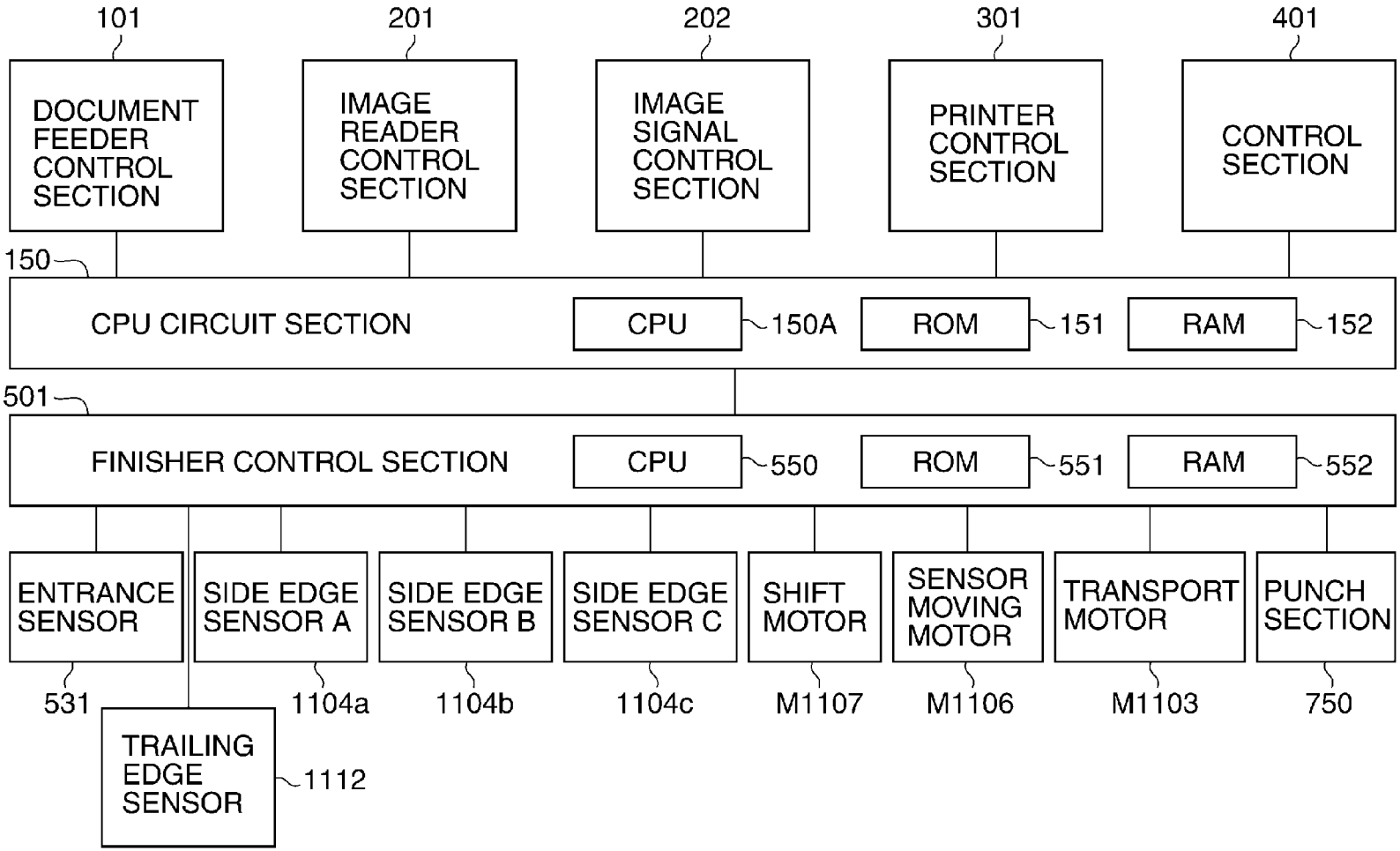
FIG. 4 is a block diagram that shows a control system of the image forming system of FIG. 1.

FIG. 4 is a block diagram that shows the control system of the image forming system 1000 of FIG. 1.

In FIG. 4, a CPU circuit section 150 is included in the image forming apparatus 10 and has a CPU 150A, a ROM 151, and a RAM 152 built-in. The CPU circuit section 150 is configured to communicate with each of control sections 101, 201, 202, 301, and 401, which will be described later. The CPU circuit section 150 is configured to communicate with a finisher control section 501 disposed in the sheet processing apparatus 500. The finisher control section 501 is configured to communicate with various sensors 531, 1112, and 1104*a* to 1104*c*, various motors M1107, M1106, and M1103, and the punch section 750 of the sheet processing apparatus 500.

The CPU circuit section 150 integrally controls each of the control sections 101, 201, 202, 301, and 401, which will be described later, through a control program stored in the ROM 151. The RAM 152 temporarily holds control data and is also used as a work area for computing processing associated with the control.

The document feeder control section 101 controls driving of the document feeding apparatus 100 based on an instruction from the CPU circuit section 150. The image reader control section 201 controls driving of the scanner unit 104, the image sensor 109, and so on of the image reader (scanner) 200 and transfers an analog image signal outputted from the image sensor 109 to the image signal control section 202. The image signal control section 202 converts the analog image signal from the image sensor 109 into a digital signal and then subjects the digital signal to each processing. Then, the image signal control section 202 converts this digital signal into a video signal to be outputted to the printer control section 301. The printer control section 301 drives the exposure control section 110 based on the video signal inputted from the image signal control section 202. The console control section 401 of the operation display apparatus 400 exchanges information between the operation display apparatus 400 shown in FIG. 1 and the CPU circuit section 150. Then, the control section 401 of the operation display apparatus 400 outputs to the CPU circuit section 150 a key signal that corresponds to an operation of each key from the operation display apparatus 400 and also displays corresponding information based on the signal from the CPU circuit section 150 on a display section of the operation display apparatus 400.

The finisher control section 501 exchanges information with the CPU circuit section 150 to control driving of the entire sheet processing apparatus 500. It should be noted that the finisher control section 501 can also be disposed in the image forming apparatus 10. The finisher control section 501 is configured of a CPU 550, a ROM 551, a RAM 552, and so on. The finisher control section 501 communicates with the CPU circuit section 150 through a communication IC, which is omitted from the drawing, to exchange data and implements various programs stored in the ROM 551 based on an instruction from the CPU circuit section 150 to control driving of the sheet processing apparatus 500. Further, the finisher control section 501 controls the shift motor M1107, the sensor moving motor M1106, the transport motor M1103, and the punch section 750 based on the entrance sensor 531, the trailing edge sensor 1112, and the side edge sensors 1104*a* to 1104*c*.

A punch processing method to be implemented by the sheet processing apparatus 500 will now be described in detail.

Figure 5:
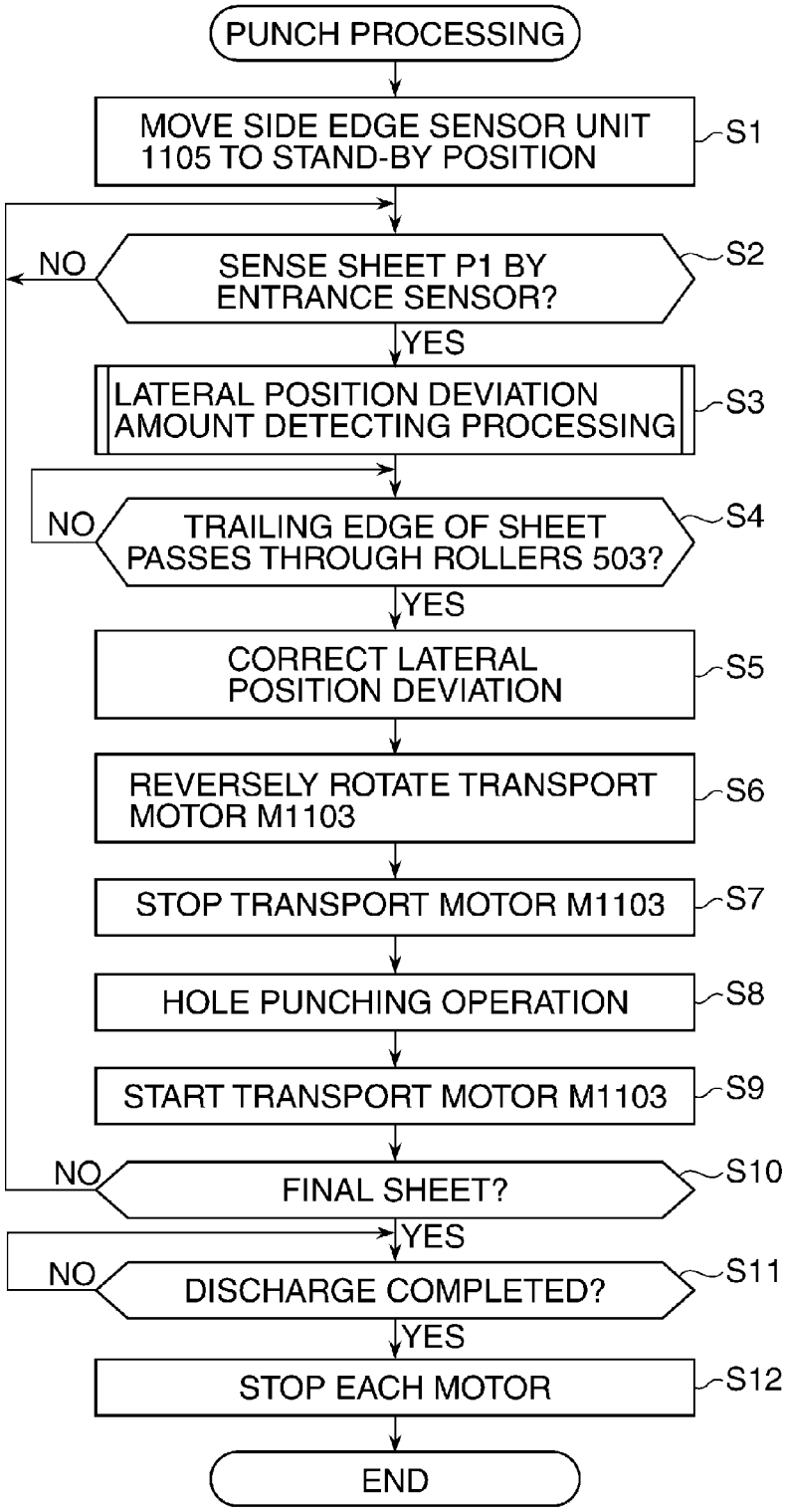
FIG. 5 is a flowchart showing the procedure of punch processing using the sheet processing apparatus of FIG. 2.

FIG. 5 is a flowchart showing the procedure of the punch processing using the sheet processing apparatus 500 of FIG. 2.

The punch processing is implemented by the CPU 550 based on an instruction to implement the punch processing from the image forming apparatus 10. At this time, the CPU 550 implements a punch processing program stored in the ROM 551 of the finisher control section 501 in the sheet processing apparatus 500. In a case where there is no instruction for the punch processing from the image forming apparatus 10, the punch processing and a sheet deviation correction that is a precondition for the punch processing are not carried out. The sheet deviation correction will be described later.

In FIG. 5, first, information on the size of a sheet to be subjected to the punch processing is acquired, and the side edge sensor unit 1105 is moved to a stand-by position corresponding to the size of the sheet (step S1). The information on the size of the sheet is notified from the CPU 150A of the image forming apparatus.

Figure 6:
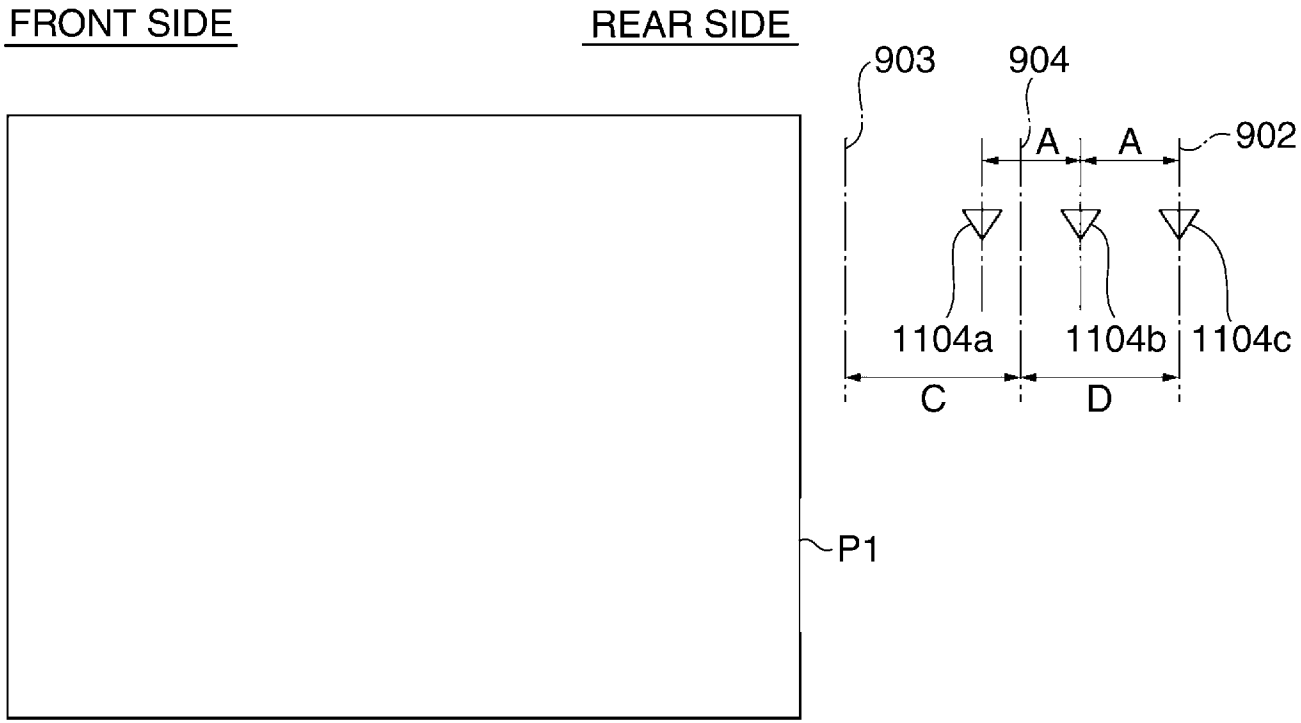
FIG. 6 is a diagram showing a relationship between a sheet and a stand-by position of a side edge sensor unit.

Here, the stand-by position of the side edge sensor unit 1105 will be described using FIG. 6. FIG. 6 is a diagram showing a relationship between a sheet P1 and the stand-by position of the side edge sensor unit 1105.

In FIG. 6, a position 903 is a sheet side edge position (a reference position) when there is no lateral position deviation, and a position 904 is a sheet side edge position when an anticipated lateral position deviation amount is at maximum. A position 902 is a position of the side edge sensor 1104*c* when the side edge sensor unit 1105 is at the stand-by position. A distance C indicates an anticipated maximum lateral position deviation amount of the sheet P1 to be transported by the shift unit 1001. A distance D is a moving distance of the side edge sensor unit 1105 from when the sensor moving motor M1106 starts driving until a moving amount of the side edge sensor unit 1105 becomes proportional to a rotation amount of the sensor moving motor M1106. That is, once the motor M1106 rotates by a rotation amount that corresponds to such an amount as to move the side edge sensor unit 1105 by the distance D (such an amount to move by a predetermined amount), the moving amount of the side edge sensor unit 1105 starts to become precisely proportional to the rotation amount of the motor M1106.

As stated above, the stand-by position 902 of the side edge sensor unit 1105 is a position where the side edge sensor 1104*c* is away from the sheet side edge position 904 by D mm when an anticipated lateral position deviation is at maximum. The side edge sensors 1104*a* and 1104*b* are arranged to be away from the side edge sensor 1104*c* by a predetermined distance of, for example, 10 mm, respectively. That is, the side edge sensor unit 1105 stands by so that the side edge sensor 1104*c* is away from the sheet side edge position 903 greater than a distance corresponding to the total of the distance C and the distance D when there is no lateral position deviation.

Through this, as the side edge sensor unit 1105 is moved from the stand-by position thereof toward a front side in FIG. 6, any one of the side edge sensors 1104*a*, 1104*b*, and 1104*c* can first detect a sheet side edge position, and the sheet deviation can be corrected from the detection result.

Referring back to FIG. 5, when the entrance sensor 531 senses a leading edge of the sheet P1 (YES to step S2), the CPU 550 implements lateral position deviation amount detecting processing of FIGS. 8A and 8B, which will be described later, to detect a lateral position deviation amount of the sheet (step S3).

Subsequently, when the trailing edge of the sheet passes through the transport rollers 503 (a sheet transport unit) (YES to step S4), the CPU 550 controls the shift unit 1001 to move in a widthwise direction of the sheet intersecting the transport direction based on the lateral position deviation amount detected in the step S3, and correct the lateral position deviation of the sheet (step S5). Whether or not the trailing edge of the sheet has passed through the transport rollers 503 is determined based on a distance of the sheet being transported from when the entrance sensor 531 senses the trailing edge of the sheet.

Subsequently, the CPU 550 controls the transport motor M1103 to reversely rotate to cause the sheet P1 to abut against a stopper (not shown), with the sheet deflected (step S6), and then controls the transport motor M1103 to be once stopped (step S7), to thereby correct oblique movement of the trailing edge of the sheet (step S7). Thereafter, the CPU 550 controls the punch section 750 to carry out a hole punching operation in a state where the sheet abuts against the stopper (step S8), and controls the transport motor M1103 to be started to restart transporting the sheet (step S9).

After the processing in steps S2 to S9 is repeated until the final sheet in a job (YES to step S10), the CPU 550 controls all the sheets to be discharged onto the tray 700 or 701 (YES to step S11), with each of the motors being stopped (step S12), followed by the program terminating.

According to the processing in FIG. 5, the lateral position deviation amount of the sheet that is discharged from the image forming apparatus 10 and transported into the sheet processing apparatus 500 is detected to be corrected, and then the hole punching operation is carried out by the punch section 750. Therefore, a desired punch hole can be made precisely at a predetermined position in the trailing edge portion of the sheet.

The lateral position deviation amount detecting processing (step S3) to be implemented in step S3 of FIG. 5 will now be described in detail.

Figure 7A:
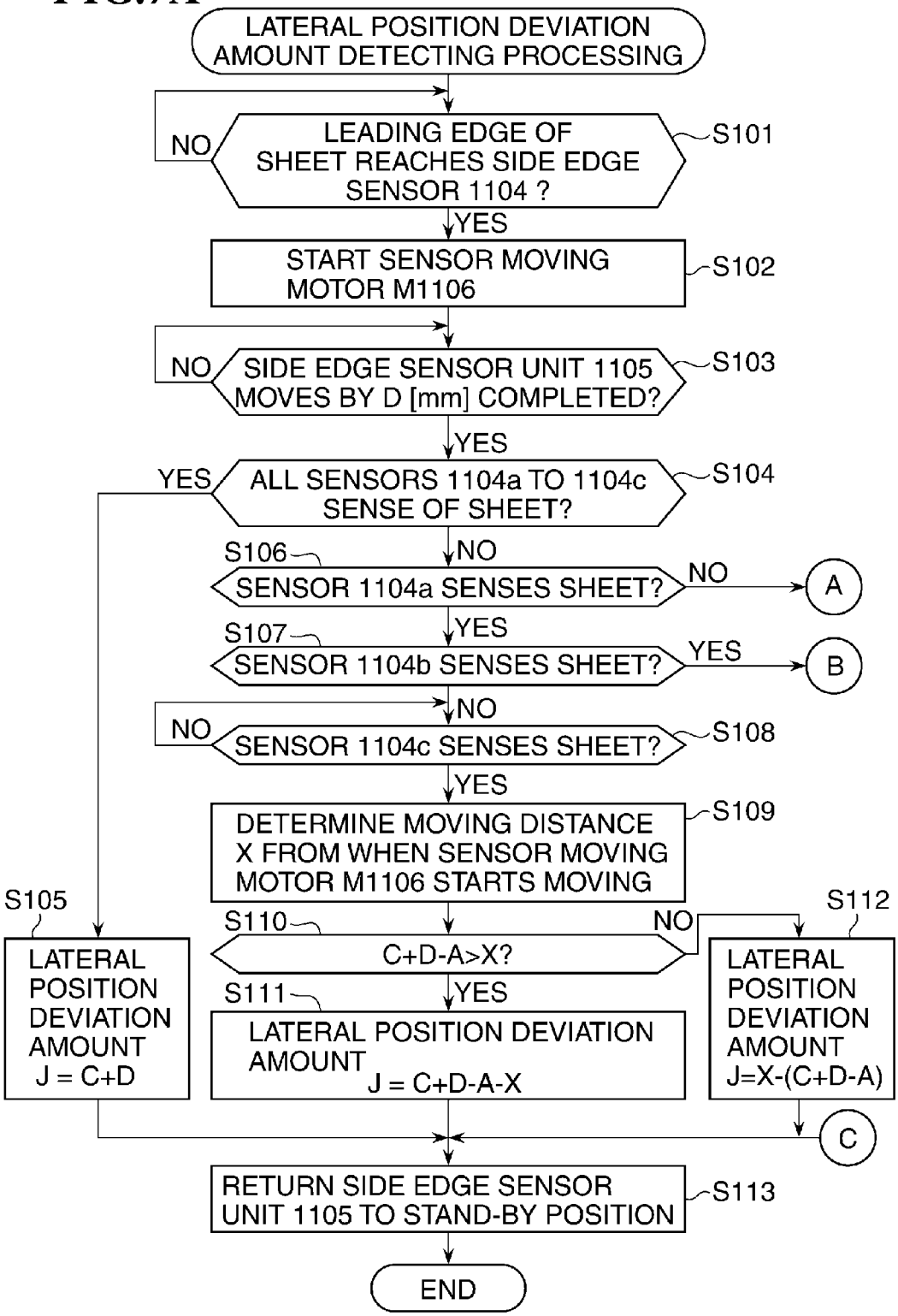
FIG. 7A is a flowchart that shows a lateral position deviation amount detecting processing method of FIG. 5.
Figure 7B:
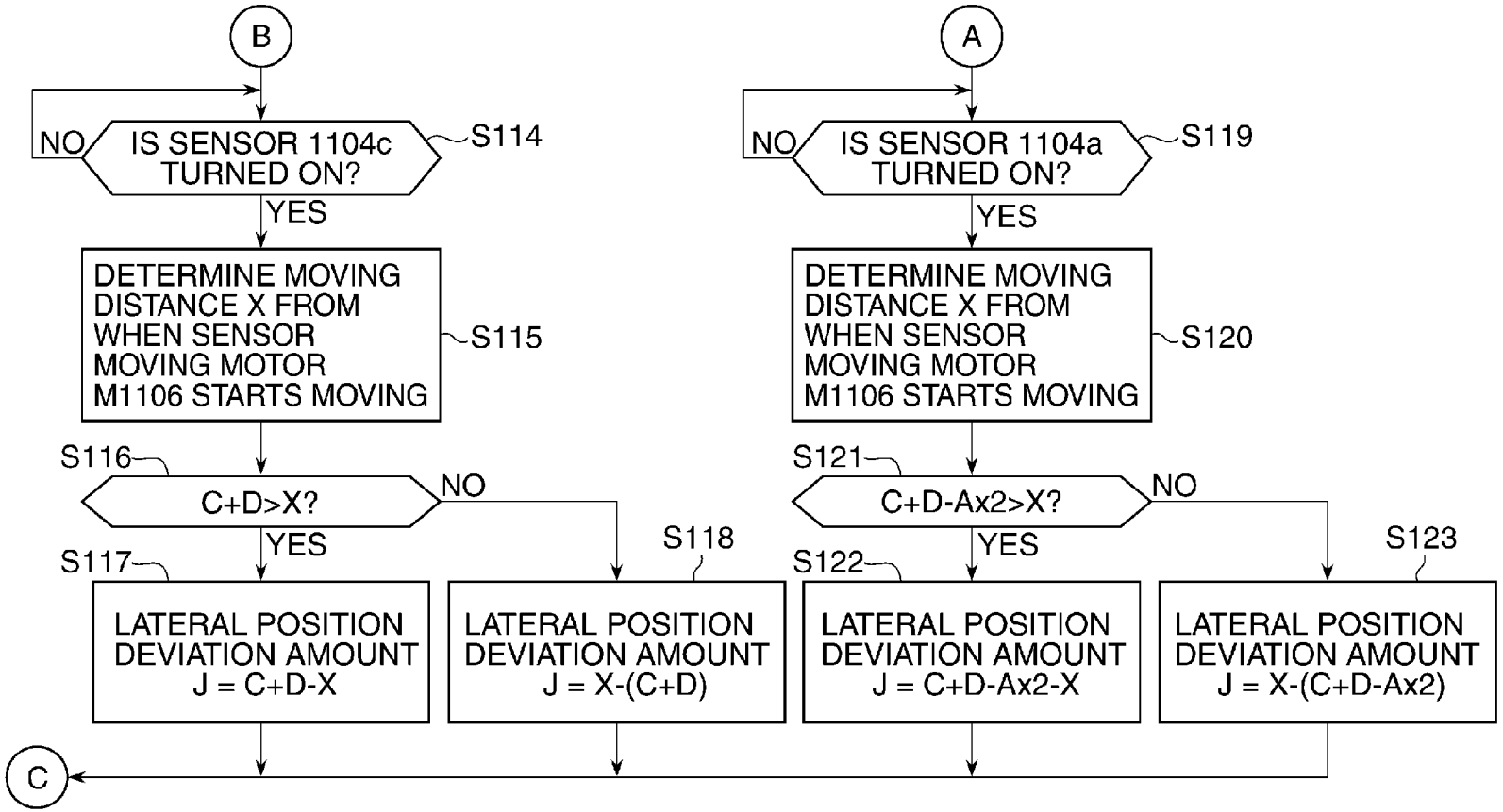
FIG. 7B is a flowchart that shows the lateral position deviation amount detecting processing method of FIG. 5.

FIGS. 7A and 7B are flowcharts showing the procedure of the lateral position deviation amount detecting processing of FIG. 5. This processing is implemented by the CPU 550. At this time, the CPU 550 implements a lateral position deviation amount detecting processing program stored in the ROM 551 of the finisher control section 501 in the sheet processing apparatus 500.

In FIG. 7A, first, when the leading edge of the sheet P1 in the sheet transport direction reaches the stand-by position of the side edge sensor unit 1105 (YES to step S101), the CPU 550 controls the sensor moving motor M1106 to be started (step S102), and then waits until the side edge sensor unit 1105 moves by the distance D [mm] (a predetermined distance) and the moving amount of the side edge sensor unit 1105 becomes proportional to the rotation amount of the sensor moving motor M1106 (step S103). After the side edge sensor unit 1105 moves by the distance D [mm] (YES to step S103), the CPU 550 determines whether or not the side edge sensors 1104*a* to 1104*c* have all sensed the sheet P1 (step S104).

As a result of the determination of the step S104, when all of the side edge sensors 1104*a* to 1104*c* sense the sheet P1 (YES to the step S104), the lateral position deviation amount exceeds an anticipated value, thereby disabling the lateral position deviation amount to be detected and corrected. Therefore, the CPU 550 determines that the position of the sheet in the width direction is deviated toward the rear side of the sheet processing apparatus by an amount equal to or more than a maximum value, that is, a correction limit width, and sets a lateral position deviation amount J to C+D (step S105). Thereafter, the CPU 550 controls the sensor moving motor M1106 to be once stopped, and controls the side edge sensor unit 1105 to be returned to the stand-by position (step S113), followed by the program terminating.

On the other hand, as a result of the determination of the step S104, when at least one of the side edge sensors 1104*a* to 1104*c* does not sense the sheet P1 (NO to the step S104), the CPU 550 determines whether or not the side edge sensor 1104*a* senses the sheet P1 (step S106).

As a result of the determination of the step S106, when the side edge sensor 1104*a* senses the sheet P1 (YES to the step S106), the CPU 550 determines whether or not the side edge sensor 1104*b* senses the sheet P1 (step S107).

As a result of the determination of the step S107, when the side edge sensor 1104*b* senses the sheet P1 (YES to step S107), the CPU 550 controls the sensor moving motor M1106 to be further driven to wait until the side edge sensor 1104*c* senses the side edge of the sheet P1 (step S114).

When the side edge sensor 1104*c* senses the side edge of the sheet P1 (YES to the step S114), the CPU 550 obtains a moving distance X [mm] of the side edge sensor unit 1105 from when the sensor moving motor M1106 starts moving until the side edge sensor 1104*c* senses the side edge of the sheet P1 is obtained (step S115).

Then, the CPU 550 determines whether or not X obtained as above is less than C+D described in FIG. 6 (step S116), and then when determines, when X is less than C+D (YES to the step S116), that the lateral position deviation of the sheet P1 is deviated toward the rear side of the sheet processing apparatus, to thereby calculate the lateral position deviation amount J through C+D−X (step S117).

On the other hand, as a result of the determination of the step S116, the CPU 550 determines, when X is not less than C+D (NO to the step S116), that the lateral position deviation of the sheet is deviated toward the front side of the sheet processing apparatus, to thereby calculate the lateral position deviation amount J through X−(C+D) (step S118).

After the processing in step S117 or S118, the CPU 550 controls the sensor moving motor M1106 to be once stopped, with the side edge sensor unit 1105 being returned to the stand-by position (step S113), followed by the program terminating.

As a result of the determination of the step S107, when the side edge sensor 1104*b* does not sense the sheet P1 (NO to the step S107), the CPU 550 controls the sensor moving motor M1106 to be further driven to wait until the side edge sensor 1104*b* senses the side edge of the sheet P1 (step S108).

When the side edge sensor 1104*b* senses the side edge of the sheet P1 (YES to the step S108), the CPU 550 determines a moving distance X [mm] of the side edge sensor unit 1105 from when the sensor moving motor M1106 starts moving until the side edge sensor 1104*b* senses the side edge of the sheet P1 (step S109).

Then, the CPU 550 determines whether or not X obtained as above is less than C+D−A (step S110), and then determines, when X is less than C+D−A (YES to the step S110), that the position of the sheet in the widthwise direction is deviated toward the rear side of the sheet processing apparatus, to thereby calculate the lateral position deviation amount J through C+D−A−X (step S111).

On the other hand, as a result of the determination of the step S110, when X is not less than C+D−A (NO to the step S110), the CPU 550 determines that the position of the sheet in the widthwise direction is deviated toward the front side of the sheet processing apparatus, to thereby calculate the lateral position deviation amount J through X−(C+D−A) (step S112).

After the processing in step S111 or S112, the CPU 550 controls the sensor moving motor M1106 to be once stopped, with the side edge sensor unit 1105 being returned to the stand-by position (step S113), followed by the program terminating.

Subsequently, as a result of the determination of the step S106, when the side edge sensor 1104*a* does not sense the sheet P1 (NO to the step S106), the CPU 550 controls the sensor moving motor M1106 to be further driven to wait until the side edge sensor 1104*a* senses the sheet P1 (step S119).

When the side edge sensor 1104*a* senses the sheet P1 (YES to the step S119), the CPU 550 obtains a moving distance X [mm] of the side edge sensor unit 1105 from when the sensor moving motor M1106 starts moving until the side edge sensor 1104*a* senses the sheet P1 (step S120).

Then, the CPU 550 determines whether or not X obtained as above is less than C+D−A×2 (step S121), and then determines, when X is less than C+D−A×2 (YES to the step S121), that the position of the sheet in the widthwise direction is deviated toward the rear side of the sheet processing apparatus, to thereby calculate the lateral position deviation amount J through C+D−A×2−X (step S122).

On the other hand, as a result of the determination of the step S121, when X is not less than C+D−A×2 (NO to the step S121), the CPU 550 determines that the position of the sheet in the widthwise direction is deviated toward the front side of the sheet processing apparatus, to thereby calculate the lateral position deviation amount J through X−(C+D−A×2) (step S123).

After the processing in step S122 or S123, the CPU 550 controls the sensor moving motor M1106 to be once stopped, with the side edge sensor unit 1105 being returned to the stand-by position (step S113), followed by the program terminating.

According to the processing of FIGS. 7A and 7B, the CPU 550 invalidates a detection result of the side edge sensor unit 1105 after the sensor moving motor M1106 is started until the moving amount of the side edge sensor unit 1105 becomes proportional to the rotation amount of the sensor moving motor M1106, and calculates the lateral position deviation amount of the sheet using a detection result of the side edge sensor unit 1105 after the moving amount of the side edge sensor unit 1105 becomes proportional to the rotation amount of the sensor moving motor M1106. Accordingly, it is possible to obtain the lateral position deviation amount of the sheet accurately without an error associated with the timing belt 47 stretching.

As described thus far, in the present embodiment, the side edge of the sheet is detected after the moving amount of the side edge sensor unit follows a driving pulse of the sensor moving motor, which prevents a detection error in the lateral position deviation amount of the sheet due to a following delay of the driving pulse of the motor and the moving amount of the sensor.

Further, in the present embodiment, the side edge sensors in the side edge sensor unit 1105 are arranged in two or more along the moving direction of the side edge sensor unit 1105, which reduces the moving amount of the side edge sensor unit 1105 until the side edge of the sheet is sensed, and enables the lateral position deviation amount of the sheet to be detected at a high speed within a short period of time.

In the present embodiment, the space (distance D) among the side edge sensors 1104*a*, 1104*b*, and 1104*c* is, for example, 5 to 25 mm, preferably 5 to 15 mm, and more preferably 10 mm. The distance D is not made greater beyond necessity, thereby reducing a necessary moving amount of the side edge sensor unit 1105, which reduces a time period required to detect the lateral position deviation amount can be reduced.

Aspects of the present invention can also be realized by a computer of a system or apparatus (or devices such as a CPU or MPU) that reads out and executes a program recorded on a non-transitory memory device to perform the functions of the above-described embodiment(s), and by a method, the steps of which are performed by a computer of a system or apparatus by, for example, reading out and executing a program recorded on a non-transitory memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority the benefit of Japanese Patent Application No. 2012-102876 filed Apr. 27, 2012, which is hereby incorporated by reference herein in its entirety.

What is claimed is:

1. A sheet processing apparatus comprising:

a sheet transport unit configured to transport a sheet;

a sheet sensing unit including two or more sensors, each of the sensors being configured to sense the sheet, disposed in a widthwise direction of the sheet intersecting a sheet transport direction by the sheet transport unit;

a driving unit configured to move said sheet sensing unit in the widthwise direction;

a drive force transmission unit configured to transmit a driving force of said driving unit to said sheet sensing unit; and a position deviation detecting unit configured to detect a position deviation amount of the sheet in the widthwise direction based on a moving distance of said sheet sensing unit through said driving unit until at least one of the two or more sensors senses the sheet, wherein said position deviation detecting unit invalidates a sensing result of the sheet by the at least one of the two or more sensors of said sheet sensing unit from when said driving unit starts driving until said sheet sensing unit moves by a predetermined distance, and determines the position deviation amount of the sheet using a detection result of the sheet after said sheet sensing unit moves by the predetermined distance.

2. The sheet processing apparatus according to claim 1, wherein the predetermined distance is a moving distance of said sheet sensing unit moves after said driving unit starts driving with a drive force of said driving unit transmitted to said sheet sensing unit through said drive force transmission unit until a driving amount of said driving unit becomes proportional to the moving distance of said sheet sensing unit.

3. The sheet processing apparatus according to claim 1, wherein said position deviation detecting unit detects a position deviation amount of the sheet when any one of the two or more sensors first senses the sheet after said sheet sensing unit moves by the predetermined distance.

4. The sheet processing apparatus according to claim 1, wherein said sheet sensing unit holds at a position in which at least one of the two or more sensors is deviated by the predetermined distance from a position of the side edge of the sheet deviated by an anticipated maximum position deviation amount of the sheet.

5. The sheet processing apparatus according to claim 1, wherein said sheet deviation detecting unit determines that the sheet is deviated by an amount equal to or more than an anticipated maximum position deviation amount of the sheet in a case where all of the two or more sensors sense the sheet when said sheet sensing unit moves by the predetermined distance.

6. The sheet processing apparatus according to claim 1, further comprising a sheet position correcting unit configured to correct a position of the sheet based on the position deviation amount detected by said sheet deviation detecting unit.

7. The sheet processing apparatus according to claim 6, further comprising a hole punching unit configured to make a punch hole in the sheet, a position of which is corrected by said sheet position correcting unit.

8. A method of detecting a lateral position deviation amount of a sheet in a sheet processing apparatus comprising a sheet transport unit configured to transport a sheet in a sheet transport direction, a sheet sensing unit including two or more sensors, each of the sensors being configured to sense the sheet, disposed in a widthwise direction of the sheet intersecting the sheet transport direction, a driving unit configured to move said sheet sensing unit in the widthwise direction, and a drive force transmission unit configured to transmit a driving force of said driving unit to said sheet sensing unit, the method comprising:

a moving step of moving said sheet sensing unit using said driving unit and said drive force transmission unit; and a detecting step of, in a case where at least one of the two or more sensors senses the sheet from when said driving means starts driving until said sheet sensing unit moves by a predetermined distance, invalidating a sensing result of the sheet by the at least one of the two or more sensors of said sheet sensing unit and detecting a position deviation amount of the sheet in the widthwise direction based on a moving distance of said sheet sensing unit until the other sensor of two or more sensor detects the sheet after the sheet sensing unit moves by the predetermined distance.

9. An image forming system including an image forming apparatus configured to form an image on a sheet, and a sheet processing apparatus comprising:

a sheet transport unit configured to transport a sheet;

a sheet sensing unit including two or more sensors, each of the sensors being configured to sense the sheet, disposed in a widthwise direction of the sheet intersecting a sheet transport direction by the sheet transport unit;

a driving unit configured to move said sheet sensing unit in the widthwise direction;

a drive force transmission unit configured to transmit a driving force of said driving unit to said sheet sensing unit; and a position deviation detecting unit configured to detect a position deviation amount of the sheet in the widthwise direction based on a moving distance of said sheet sensing unit through said driving unit until at least one of the two or more sensors senses the sheet, wherein said position deviation detecting unit invalidates a detection result of the sheet by said sheet sensing unit in the widthwise direction from when said driving unit starts driving until said sheet sensing unit moves by a predetermined distance, and determines the position deviation amount of the sheet using a detection result of the sheet after said sheet sensing unit moves by the predetermined distance.

10. The image forming system according to claim 9, wherein the predetermined distance is a moving distance of said sheet sensing unit moves after said driving unit starts driving with a drive force of said driving unit transmitted to said sheet sensing unit through said drive force transmission unit until a driving amount of said driving unit becomes proportional to the moving distance of said sheet sensing unit.

11. The image forming system according to claim 9, wherein said position deviation detecting unit detects a position deviation amount of the sheet when any one of the two or more sensors first senses the sheet after said sheet sensing unit moves by the predetermined distance.

12. The image forming system according to claim 9, wherein said sheet sensing unit holds at a position in which at least one of the two or more sensors is deviated by the predetermined distance from a position of the side edge of the sheet deviated by an anticipated maximum position deviation amount of the sheet.

13. The image forming system according to claim 9, wherein said sheet deviation detecting unit determines that the sheet is deviated by an amount equal to or more than an anticipated maximum position deviation amount of the sheet in a case where all of the two or more sensors sense the sheet when said sheet sensing unit moves by the predetermined distance.

14. The image forming system according to claim 9, further comprising a sheet position correcting unit configured to correct a position of the sheet based on the position deviation amount detected by said sheet deviation detecting unit.

15. The image forming system according to claim 14, further comprising a hole punching unit configured to make a punch hole in the sheet, a position of which is corrected by said sheet position correcting unit.

* * * * *